US008794112B2

(12) United States Patent
Yu

(10) Patent No.: US 8,794,112 B2
(45) Date of Patent: Aug. 5, 2014

(54) ADJUSTABLE WRENCH WITH RATCHET FUNCTION

(75) Inventor: Tsai Shun Yu, Taichung (TW)

(73) Assignees: Tsai Shun Yu, Taichung (TW); Super DPD. Co., Ltd., Changhua County (TW)

( * ) Notice: Subject to any disclaimer, the term of this patent is extended or adjusted under 35 U.S.C. 154(b) by 225 days.

(21) Appl. No.: 13/524,554

(22) Filed: Jun. 15, 2012

(65) Prior Publication Data

US 2013/0036875 A1 Feb. 14, 2013

(30) Foreign Application Priority Data

Aug. 10, 2011 (TW) ..... 100128449 A

(51) Int. Cl.
*B25B 13/14* (2006.01)
*B25B 13/46* (2006.01)

(52) U.S. Cl.
CPC ..... *B25B 13/14* (2013.01); *B25B 13/46* (2013.01)
USPC ..... 81/165; 81/126

(58) Field of Classification Search
USPC ..... 81/126, 133, 142–145, 149, 157, 158, 81/161, 162, 168, 170–173
See application file for complete search history.

(56) References Cited

U.S. PATENT DOCUMENTS

| | | | | |
|---|---|---|---|---|
| 2,970,502 | A * | 2/1961 | Nordgren | 81/126 |
| 3,312,129 | A * | 4/1967 | Nordgren | 81/126 |
| 3,349,654 | A * | 10/1967 | Nordgren | 81/126 |
| 3,926,077 | A * | 12/1975 | Nordgren | 81/126 |
| 6,418,819 | B1 * | 7/2002 | Kuo | 81/165 |
| 7,275,464 | B2 * | 10/2007 | Chervenak et al. | 81/165 |
| 8,074,540 | B2 * | 12/2011 | Huang | 81/145 |
| 8,136,429 | B2 * | 3/2012 | Wu | 81/165 |
| 8,276,484 | B2 * | 10/2012 | Huang | 81/165 |
| 8,549,961 | B2 * | 10/2013 | Huang | 81/165 |
| 2012/0055292 | A1 * | 3/2012 | Cheng | 81/165 |
| 2012/0180604 | A1 * | 7/2012 | Huang | 81/157 |

FOREIGN PATENT DOCUMENTS

| | | |
|---|---|---|
| TW | 488338 | 5/2002 |
| TW | M300594 | 11/2006 |
| TW | I340065 | 4/2011 |

* cited by examiner

*Primary Examiner* — David B Thomas

(74) *Attorney, Agent, or Firm* — Chun-Ming Shih

(57) ABSTRACT

An adjustable wrench includes a fixed jaw, a movable jaw slidably disposed in the fixed jaw, a movable member disposed in the fixed jaw for driving the movable jaw to move, a handle pivoted on the fixed jaw for being pivoted back and forth relative to the fixed jaw, a stop pin and a switch post. The stop pin and the switch post are disposed on the handle, which allows the stop pin to move to a first position where the stop pin keeps the movable member from moving along an axial direction and a second position where the stop pin allows the movable member to move along the axial direction. The switch post is provided to control the movement of the handle. The adjustable wrench has a very small maximum clamping opening angle for turning the handle away from the fixed jaw when reversely operating the adjustable wrench.

7 Claims, 10 Drawing Sheets

ADJUSTABLE WRENCH WITH RATCHET FUNCTION

BACKGROUND OF INVENTION

1. Field of Invention

The invention relates to an adjustable wrench with ratchet function, and more especially to an adjustable wrench having a very small maximum clamping opening angle between the handle and the fixed jaw when reversely operating the adjustable wrench.

2. Related Prior Art

Please refer to FIG. 8, which is a perspective drawing showing the operation of a conventional adjustable wrench. First, the clamping opening 90 of the conventional adjustable wrench is fitted with a hexagonal nut 91. Then, the conventional adjustable wrench is turned clockwise to a certain angle to rotate the hexagonal nut 91 as shown in FIG. 8. However, if it it necessary to further fasten the hexagonal nut tightly, it is desired to move the conventional adjustable wrench away from the hexagonal nut 91, that is, to detach the hexagonal nut 91 from the clamping opening 90 of the conventional adjustable wrench, and then to repeat the fitting and turning process. As such, the hexagonal nut 91 can be firmly fastened or disengaged after repeating several operating processes. In other words, the conventional adjustable wrench cannot be directly turned counterclockwise; otherwise the hexagonal nut would be turned with the wrench to the original position. This causes inconveniences in operating.

Taiwan Patent No. 488338 discloses a conventional adjustable wrench, which is particularly configured with a reversible function. Specifically, the hexagonal nut in the clamping opening of the conventional adjustable wrench would not be turned back to the original position when the wrench is turning reversely. As such, the wrench would not have to disengage from the hexagonal nut after each turning stroke during fastening or unfastening the hexagonal nut. However, as shown in FIG. 9, a maximum clamping opening angle between the fixed jaw and the handle is very large, about 24 degree angle, when reversely using the conventional adjustable wrench.

FIG. 10 is a perspective drawing showing a different kind of the conventional adjustable wrench, such as disclosed in Taiwan Patent No. I340065, which has a maximum clamping opening angle between the fixed jaw and the handle. The maximum clamping opening angle is still quite large, about 10 degree angle. Taiwan Patent No. M300594 has a problem similar to those mentioned above.

Besides, some of the previously mentioned adjustable wrenches further comprise a switch member, such as the stopping post disclosed by Taiwan Patent No. 488338 and the driving member disclosed by Taiwan Patent NO. I340065, which is used to switch the conventional adjustable wrench in a traditional mode or in a ratchet mode. When the traditional adjustable wrench is in the traditional mode, the traditional adjustable wrench as shown in FIG. 8 is not allowed to turned reversely. When the traditional adjustable wrench is in the ratchet mode, they are thus allowed to turned reversely. It is noted that they are still operated in the conventional process as shown in FIG. 8 even though a user operates these traditional adjustable wrench with reversible function. However, the switch member of these traditional adjustable wrench is disposed away from a position of user's thumb when the user holds the adjustable wrench, which would cause seriously inconveniences while switching.

SUMMARY OF INVENTION

The present invention discloses adjustable wrench with ratchet function, which includes a fixed jaw, a movable jaw slidably disposed in the fixed jaw, a movable member disposed in the fixed jaw for driving the movable jaw to move, a handle pivoted on the fixed jaw, and a stop pin and a switch post that are disposed on the handle. The handle can be pivoted back and forth related to the fixed jaw, which allows the stop pin to move to a first position where the stop pin keeps the movable member from moving along an axial direction and a second position where the stop pin allows the movable member to move along the axial direction. The switch post is provided to control the movement of the handle.

Preferably, the movable member includes a threaded shaft, an axial rod, and a spring. The fixed jaw has a body and a sector block extending from a bottom of the body. The body has a sliding slot, a receiving groove in communication with the sliding slot, a through slit parallel with the sliding slot, and a communicating hole perpendicular to the through slit. The through slit communicates with the receiving groove. The communicating hole vertically communicates with the through slit. An arc edge of the sector block has a first notch and a second notch. A movable jaw has a sliding rod, and the sliding rod is slidably disposed in the sliding slot of the fixed jaw. A threaded shaft has a shaft hole defined therein, which is disposed in the receiving groove of the fixed jaw and engaged with a toothed portion of the sliding rod of the movable jaw. The axial rod is inserted through the through slit, the receiving groove and the shaft hole of the threaded shaft, allowing the axial rod to axially move in the through slit along an axial direction of the through slit. The axial rod further has a stop portion against a bottom rim of the threaded shaft. A spring is disposed in the through slit for allowing the axial rod being elastically movable along the axial direction. A handle has a pivot trench defined in the top end of the handle, which are capable of receiving the sector block. The top end of the handle is pivoted on an apex of the sector block. The handle further has a recess and a through hole communicating with the pivot trench, wherein the recess faces the communicating hole of the fixed jaw, and the though hole is adjacent to the recess and faces the first notch of the sector block. A stop pin has a top portion and a bottom portion. The top portion of the stop pin inserts through the communicating hole of the fixed jaw and enters the through slit, allowing the top portion to be against the axial rod. The bottom portion of the stop pin enters the recess of the handle and is pivoted on the handle with a gap between the recess and the bottom portion of the stop pin. The switch post inserts through the through hole of the handle and is capable of being movable within the through hole. The switch post has a first end protruding toward outside of the through hole and a second end entering the first notch of the sector block. The switch post has a unlock position where the first notch allows the second end of the switch post to move therein and a lock position where the first notch keeps the second end of the switch post from moving.

Preferably, the adjustable wrench further comprises a return spring and an axle. The return spring is disposed in the second notch of the sector block. The axle is fixed in the handle, and a part of the axle is located in the second notch to be against the return spring.

Preferably, the switch post has a ball and a spring. The ball is pushed by the spring to be against an inner wall of the through hole, thereby allowing the switch post to maintain a certain tightness with the inner wall of the through hole 44 when moving.

It is noted that the adjustable wrench of the present invention is designed to be reversible, in which they can drive a hexagonal nut to rotate in one direction and also keep the hexagonal to run idle in the reverse direction. Moreover, it is worth to mention that when counterclockwise operating the adjustable wrench 1, a maximum clamping opening angle for turning the handle away from the fixed jaw is quite small, about 3 degree angle. In addition, the knob of the adjustable wrench of the present invention has a size approximately equal to that of the user's thumb. As such, the adjustable wrench of the present invention can achieve the benefits of convenient operations.

As described above, other features, objects, aspects and advantages will be identified and described in detail below.

DETAILED DESCRIPTION OF EMBODIMENTS

Figure 1:
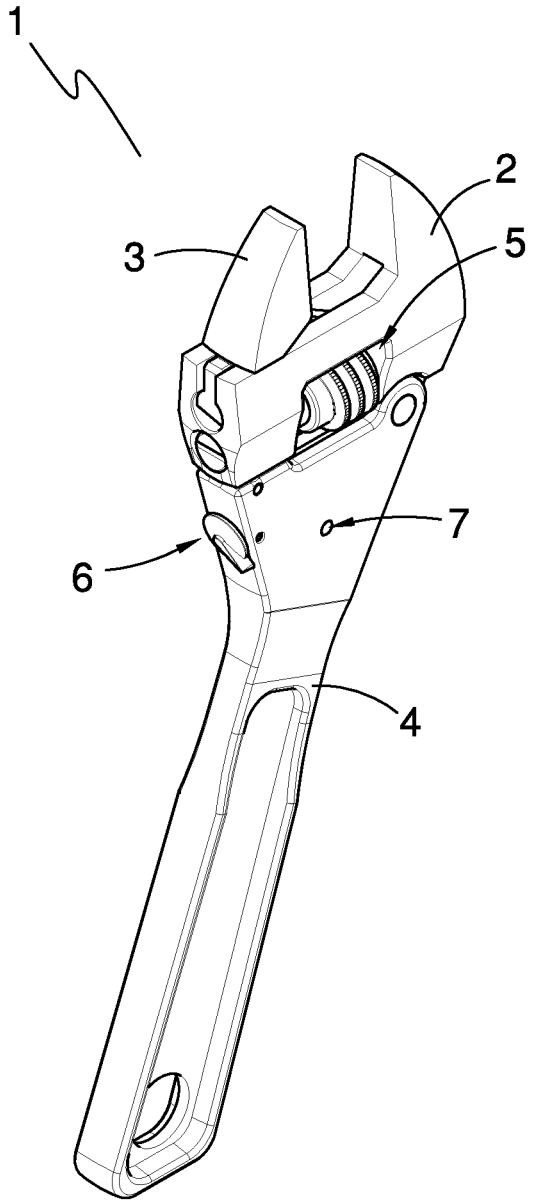
FIG. 1 is a perspective three-dimensional drawing of one embodiment of the present invention.
Figure 2:
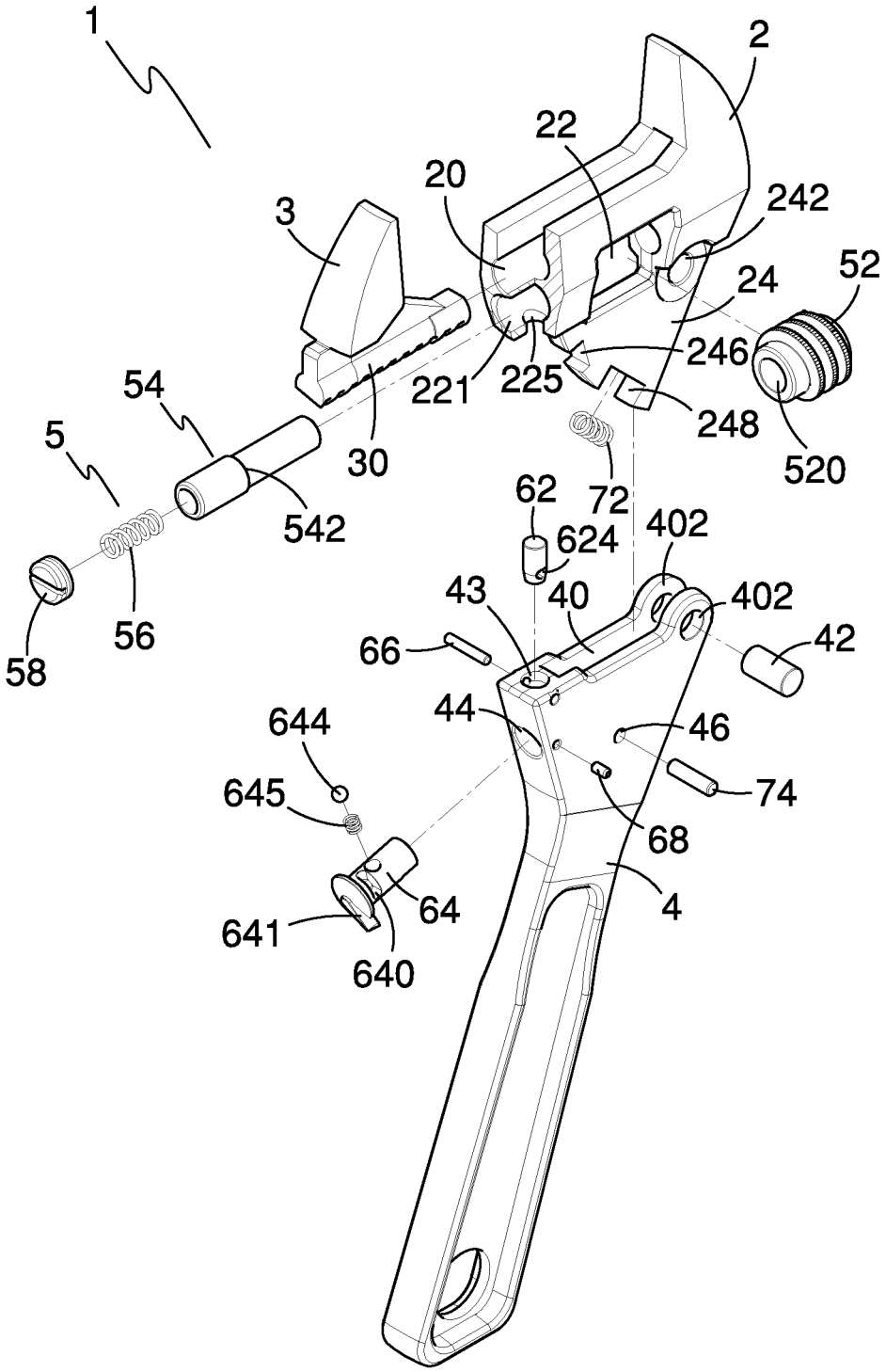
FIG. 2 is a perspective three-dimensional exploded drawing of one embodiment of the present invention.
Figure 3:
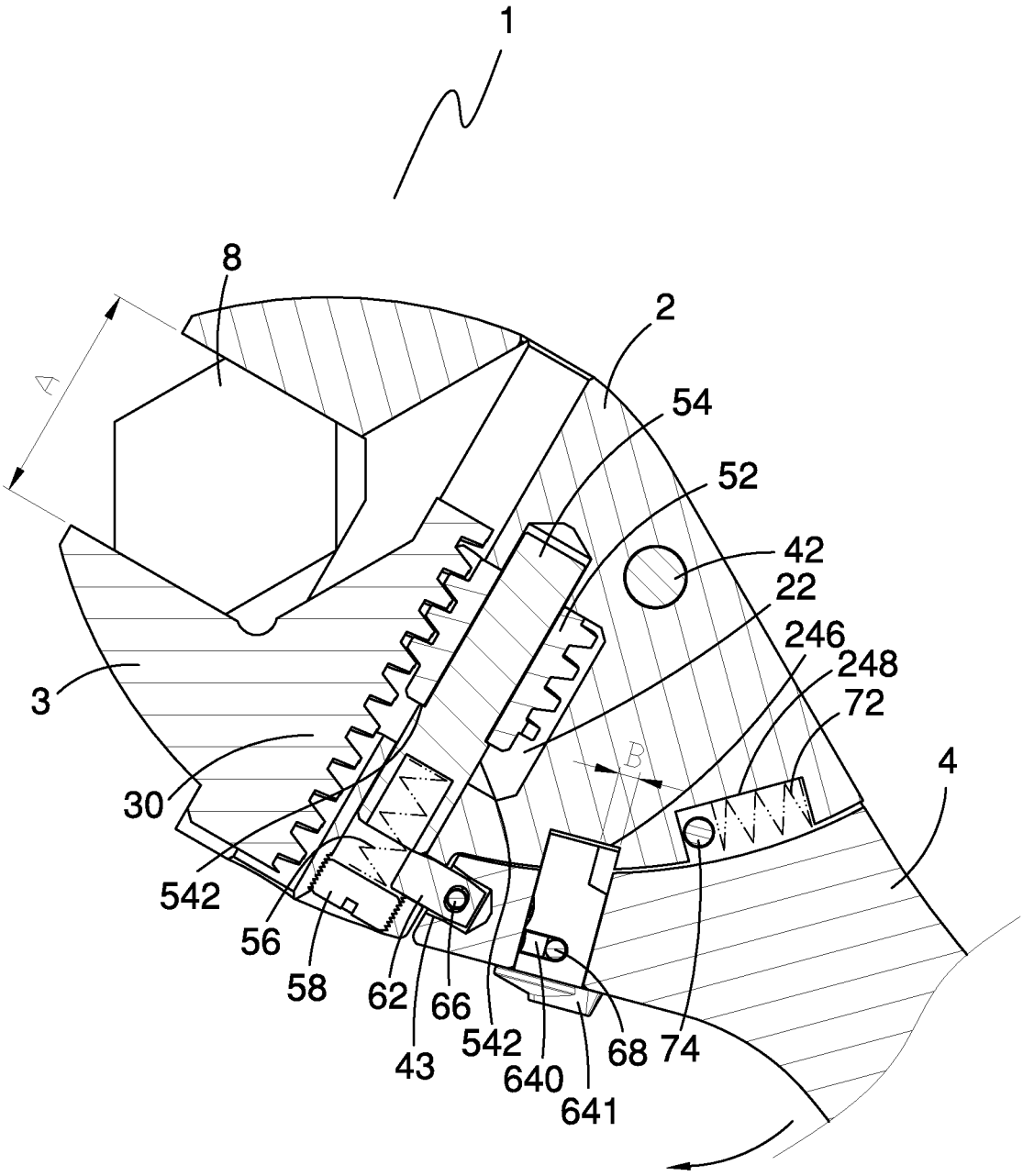
FIG. 3 is a perspective three-dimensional drawing showing a unlocked position where the clamping opening of the adjustable wrench receives clamps a hexagonal nut when the adjustable wrench is in a ratchet mode.

Please refer to FIG. 1 to FIG. 3, which are perspective drawings of one embodiment of the present invention. As shown in FIG. 1, the adjustable wrench with ratchet function of the present invention comprises a fixed jaw 2, a movable jaw 3, a handle 4, a movable member 5, resisting member 6 and a return member 7.

As shown in FIGS. 2 and 3, the fixed jaw 2 has a body, and the body includes a sliding slot 20, a receiving groove 22 defined therein. The sliding slot 20 is disposed above the receiving groove 22 and in communication with the sliding slot the receiving groove 22. The fixed jaw 2 further has a through slit 221 and a communicating hole 225 defined therein. The through slit 221 is parallel with the sliding slot 20. One end of the through slit 221 communicates with outside and the other end of the through slit 221 communicates with the receiving groove 22. The communicating hole 225 is perpendicular to the through slit. One end of the communicating hole 225 communicates with outside and the other end of the communicating hole 225 vertically communicates with the through slit 221.

The movable jaw 3 has a sliding rod 30. The movable jaw 3 is slidably disposed in the sliding slot 20 of the fixed jaw 2.

The movable member 5 includes a threaded shaft 52, a axial rod 54, a spring 56 and a joint pin 58. The threaded shaft 52 has a shaft hole 520 defined therein. The threaded shaft 52 is disposed in the receiving groove 22 of the fixed jaw 2 and engaged with a toothed portion of the sliding rod 30 of the movable jaw 3. The axial rod 54 is inserted through the through slit 221, the receiving groove 22 and the shaft hole 520 of the threaded shaft 52. The axial rod 54 is axially movable in the through slit 221 along an axial direction of the through slit 221. The axial rod 54 has a stop portion 542 against a bottom rim of the threaded shaft. The joint pin 58 is screwed into the through slit 221 and has a distance from the axial shaft 54. The spring 56 is disposed in the through slit 221, and has two opposite ends against the axial rod 54 and the joint pin 58 respectively for allowing the axial rod 54 being elastically movable along the axial direction. Moreover, when the thread shaft 52 is driven to rotate by the engagement of the threaded shaft 52 and the sliding rod 30, the sliding rod 30 is moved along the sliding slot 20, which would urge the movable jaw 3 being sliding relative to the fixed jaw 2. Thus, a width of a clamping opening of the adjustable wrench can be adjusted, so as to achieve the purpose of being applicable to all kinds of hexagonal nut with different size.

The fixed jaw 2 further includes a sector block 24 extending from a bottom of the body. The sector block 24 has a first pivot bore 242 defined around the vertex thereof. The sector block 24 further has a first notch 246 and a second notch 248, and both of the first notch 246 and the second notch 248 are defined in an arc edge of the sector block 24.

The handle 4 has two opposite walls at a top end of the handle 4 and a pivot trench 40 bounded by the two opposite walls. The sector block 24 of the fixed jaw 2 is installed within the pivot trench 40. The handle 4 further has two second pivot bore 402 respectively defined in the two opposite walls, and the two second pivot bore 402 face the first pivot bore 242 of the fixed jaw 2. A pivot pin 42 is inserted through the first pivot bore 242 of the sector block 24 and the two second pivot bore 402 of the handle 4, allowing the fixed jaw 2 to be pivoted with the handle 4 on an apex of the sector block 24. The handle 4 further has two opposite wide surfaces, two opposite narrow surfaces, a recess 43 and a though hole 44 adjacent to the recess 43. The through hole 44 is defined in one of the narrow surfaces and communicates with the pivot trench 40. The recess 43 is defined in the top surface of the handle 4 and faces the communicating hole 225 of the fixed jaw 2.

Figure 6:
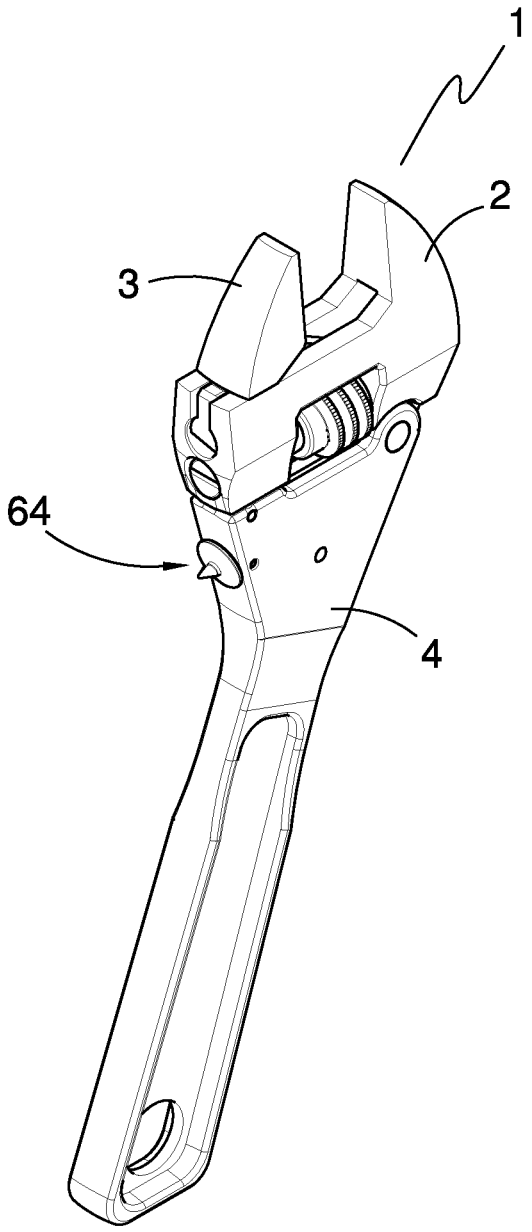
FIG. 6 is a perspective drawing showing a unlocked position where the adjustable wrench is in a traditional mode according to one embodiment of the present invention.
Figure 7:
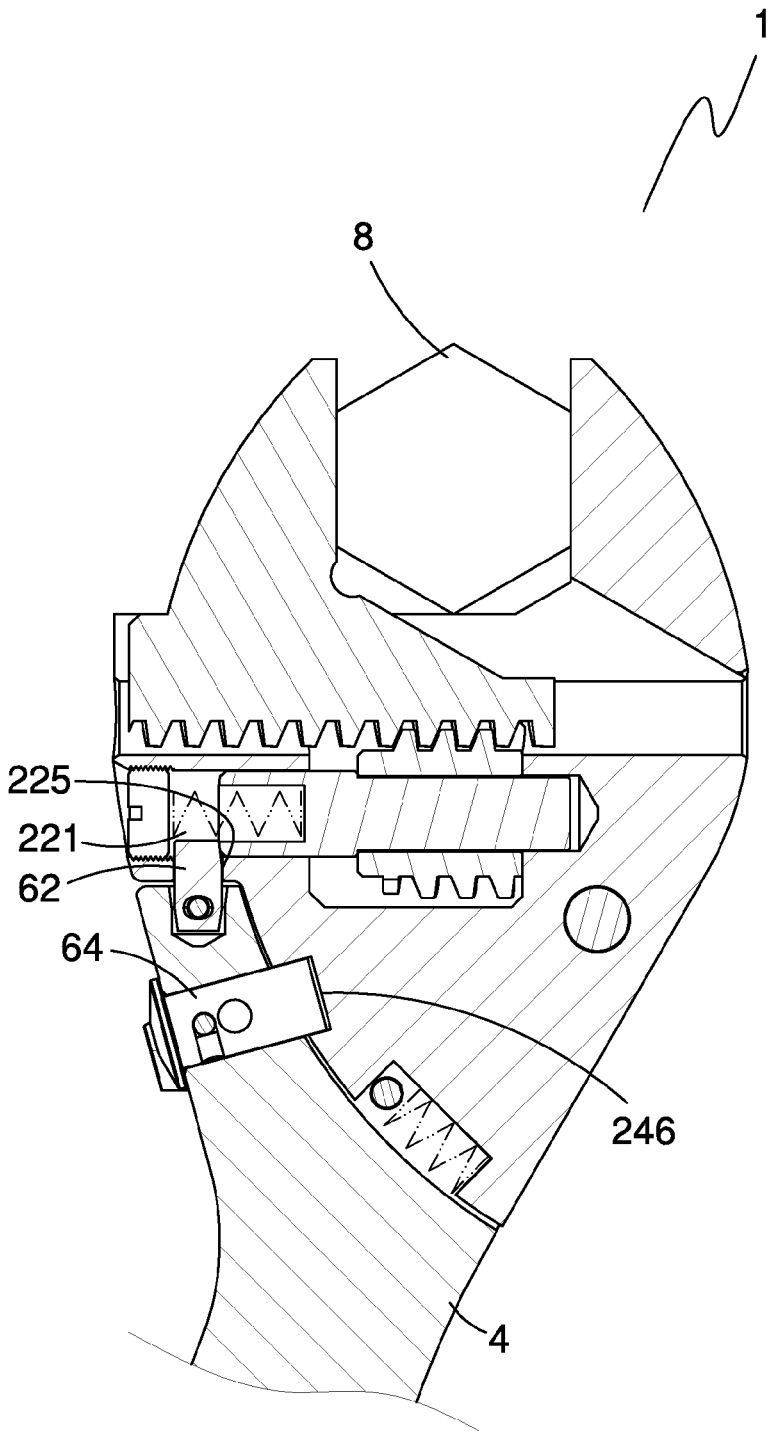
FIG. 7 is a perspective drawing showing a unlocked position where the clamping opening receives the hexagonal nut when the adjustable wrench is in a traditional mode according to one embodiment of the present invention.

The resisting member 6 includes a stop pin 62, a switch post 64, a inserting pin 66 and a limited axle 68. The stop pin 62 has a top portion and a bottom portion. The top portion of the stop pin 62 is inserted in the communicating hole 225 of the fixed jaw 2 and abuts against an end of the axial rod 54, which keeps the axial rod 54 from moving along the axial direction. The bottom portion of the stop pin 62 protrudes from the communicating hole 225 and enters the recess 43 of the handle 4 with a gap between the recess 43 and the bottom portion. Specifically speaking, there is a gap between the external surface of the bottom portion of the stop pin 62 and the internal walls of the recess 43 when the stop pin 62 enters the recess 43. A lateral hole 624 is formed in the stop pin 62 along a direction perpendicular to the axial direction of the stop pin 62. The inserting pin 66 passes through the lateral hole 624 and the two ends of the inserting pin 66 is fixed in the handle 4. The inserting pin 66 has a diameter slightly smaller than that of the lateral hole 624, enabling the inserting pin 66 to rotate corresponding to the stop pin 62. The switch post 64 is inserted through the through hole 44, and has a first end protruding toward outside of the through hole 44 and a knob 641 at the first end. The knob 641 is provided to be twisted by a user's thumb, which incurs the switch post 64 to rotate. The switch post 64 further has a second end opposite to the first end, and the second end enters the first notch 246 of the sector block 24. It is to be noted that the second end of the switch post 64 is a circular-segment-like shape, and the circular-segment-like shape of the second end of the switch post 64 has a diameter and a chord. The diameter of the second end of the switch post 64 is approximately equal to the length of the first notch 246, and the chord of the second end of the switch post 64 is less than the length of the first notch 246. More specifically, as shown in FIG. 1 to FIG. 5, when the switch post 64 is rotated at a unlock position, the chord direction of the second end of the switch post 64 is parallel to the length direction of the first notch 246, such that the second end of the switch post 64 in the first notch 246 has a gap B away from the inner wall of the first notch 246 (as shown in FIG. 3), allowing the switch post 64 to move in the first notch 246. Furthermore, as shown in FIG. 6 to FIG. 7, when the switch post 64 is rotated at a locked position, the diameter direction of the second end of the switch post 64 is parallel to the length direction of the first notch 246, such that there is no gap between the second end of the switch post 64 and the first notch 246, thereby keeping the second end of the switch post 64 from moving. The switch post 64 further has a curve ditch 640 defined at the first end thereof for receiving the limited axle 68. One end of the limited axle 68 is inserted through the curve ditch 640, which keeps the switch post 64 from dropping from the through hole 44 and keeps the switch post 64 to rotate in a predetermined range. The switch post 64 further has a ball 644 and a spring 645. The ball 644 is pushed by spring 645 to abut against the inner wall of the through hole 44, allowing the switch post 64 maintain a certain tightness with the inner wall of the through hole 44 when moving.

The return member 7 includes a return spring 72 and an axle 74. The return spring 72 is disposed in the second notch 248 of the sector block 24. Two ends of the axle 74 respectively pass through the two apertures 46 defined in the two opposite walls of the handle 4, and the axle 74 is fixed in the handle 4 and against one end of the return spring 72 in the second notch 248.

Figure 4:
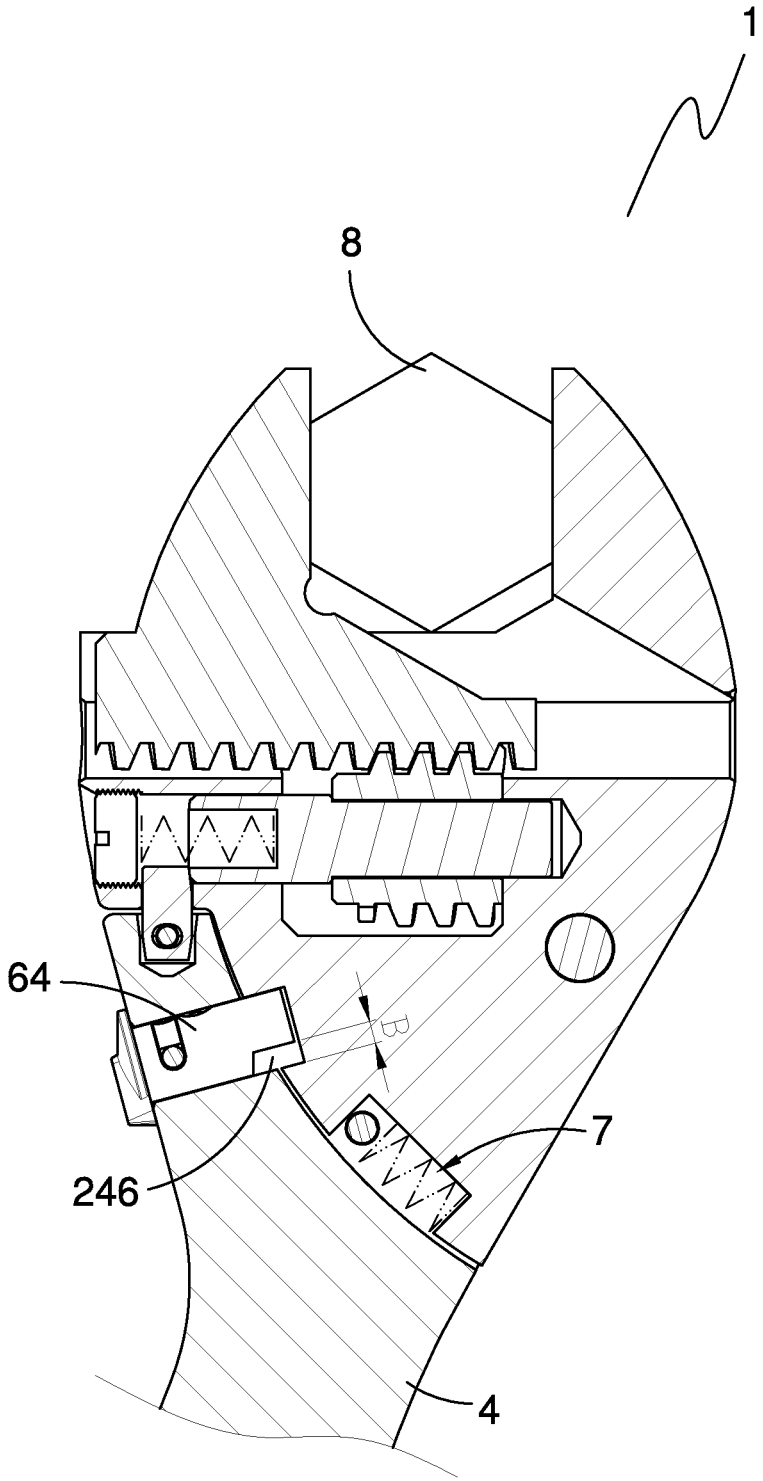
FIG. 4 is a perspective three-dimensional drawing showing a unlocked position where the clamping opening of the adjustable wrench clamps a hexagonal nut when the adjustable wrench is in a ratchet mode.
Figure 5:
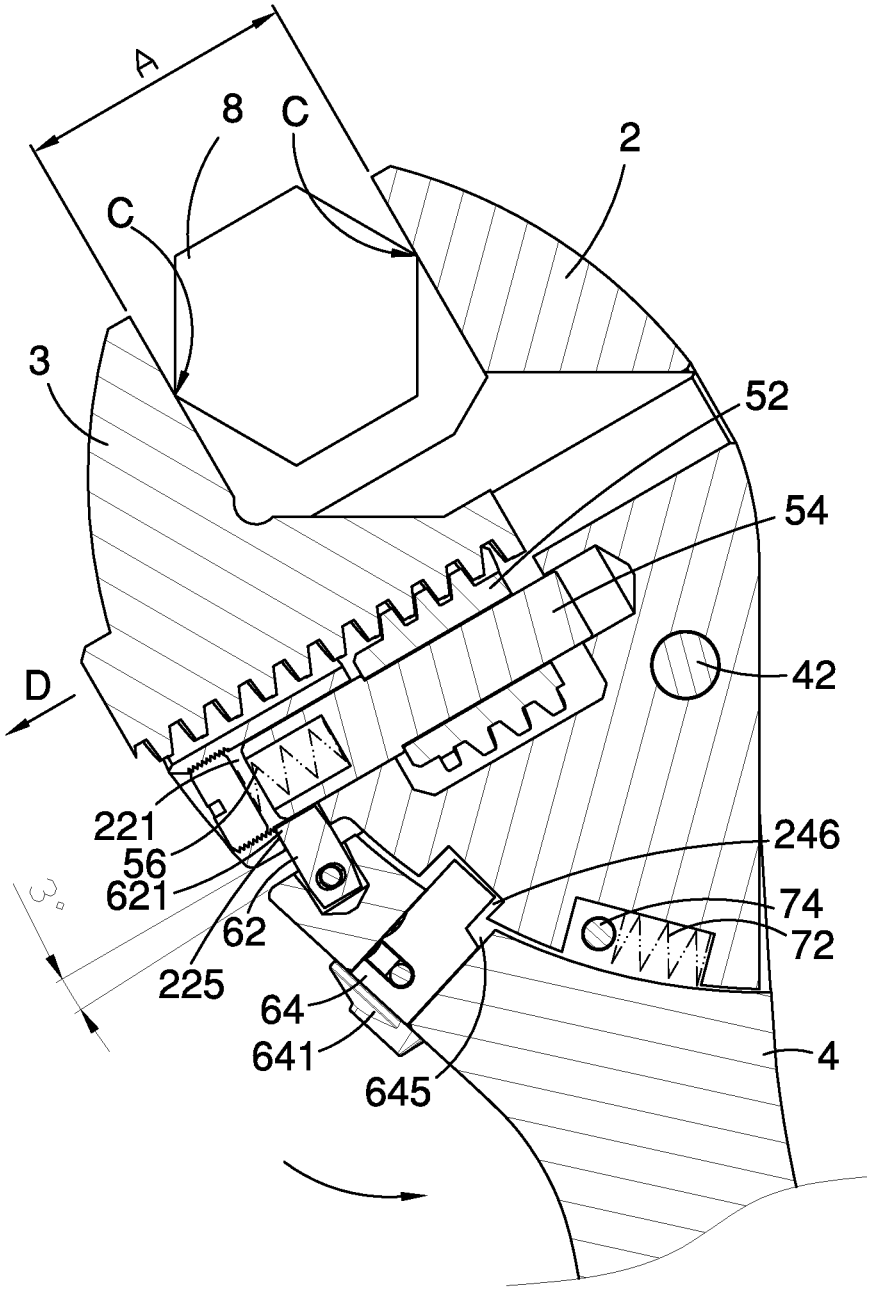
FIG. 5 is a perspective drawing showing a unlocked position where the adjustable wrench counterclockwise rotated a hexagonal nut when the adjustable wrench is in a ratchet mode.

Please refer to FIG. 3 to FIG. 5, which are perspective drawings showing a usage state where the clamping opening of the adjustable wrench 1 receives and clamps a hexagonal nut when the adjustable wrench 1 is in a ratchet mode. When the adjustable wrench 1 is in a ratchet mode, the switch post 64 is in the unlocked position. When the adjustable wrench 1 is turned clockwise by holding the handle 4, the hexagonal nut 8 is thus turned clockwise for an angle as shown in FIG. 3 and FIG. 4. After that, when the adjustable wrench 1 is turned counterclockwise by holding the handle 4, the second end of the switch post 64 in the first notch 246 is capable of moving in the gap B of in the first notch 246 because there is enough space in the first notch 246. As such, as shown in FIG. 5, the handle 4 can be slight opened by pivoting upon the pivot pin 42 corresponding to the fixed jaw 2, and keep the stop pin 62 being withdrawn from the through slit 225 to the the communicating hole 225. At this time, the axial rod 54 is free from being stopped by the stop pin 62. As such, the movable jaw 3, the threaded shaft 52 and the axial rod 54 are pushed by two edges C of the hexagonal nut 8, and move along an indicate direction of the arrow D simultaneously. Therefore, the hexagonal nut 8 is not turned counterclockwise with the counterclockwise movement of the handle 4. In other words, when the handle is counterclockwise turned, the hexagonal nut 8 is not turned then. This shows that the hexagonal nut 8 can be fastened tightly (or disengaged) by repeating clockwise and counterclockwise operation of the handle 4, and there is no need to let the clamping opening A of the handle 4 being moved away from the hexagonal nut 8. The return spring 72 is depressed by the axle 74 when the handle is turned counterwise. Meanwhile, the return spring 72 provides an elastic force, enabling the handle 4, the switch post 64 and the stop pin 62 moving back to the original position as shown in FIG. 3 and FIG. 4.

Figure 8:
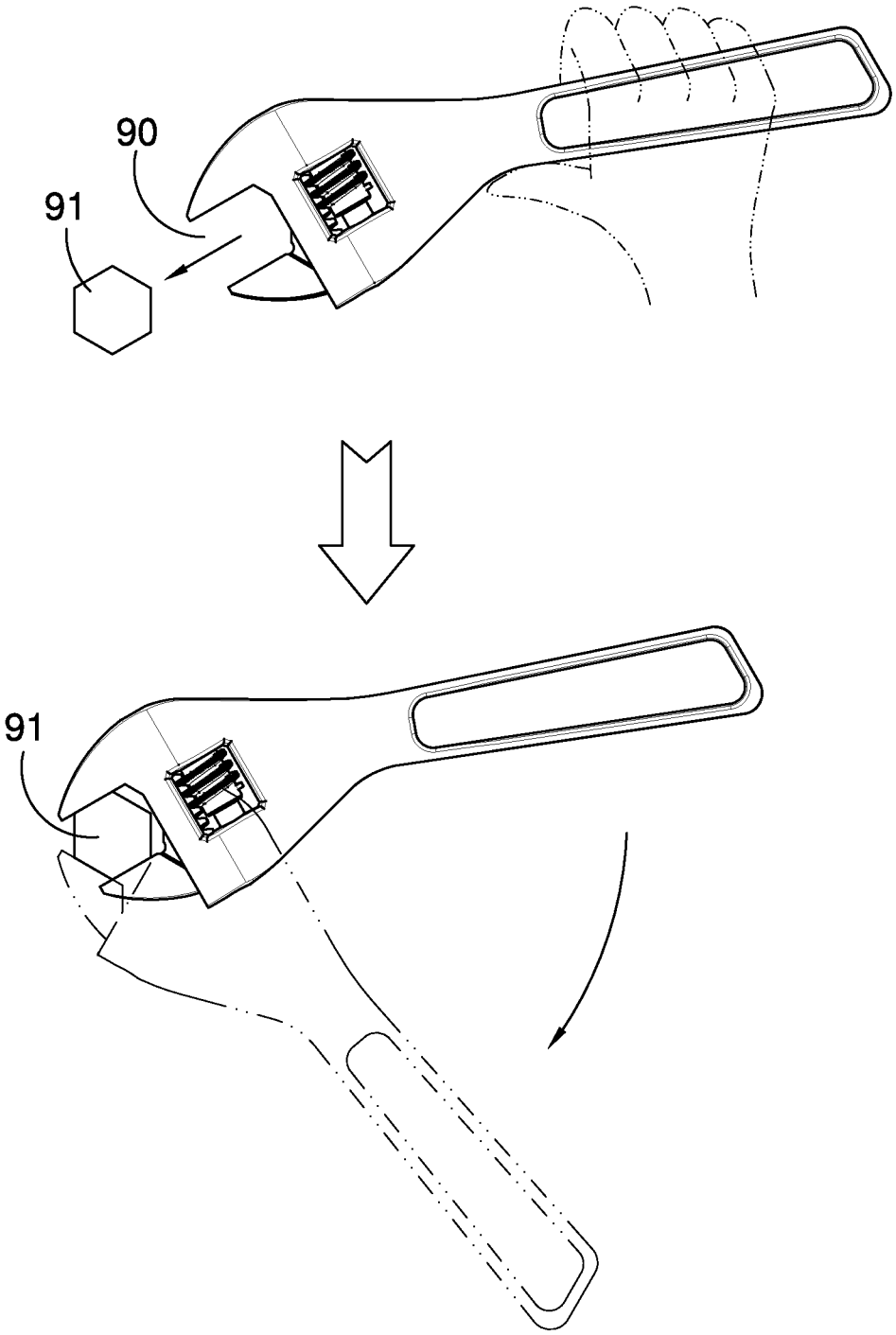
FIG. 8(Prior Art)
FIG. 8 is a perspective drawing showing the operation of a conventional adjustable wrench.
Figure 9:
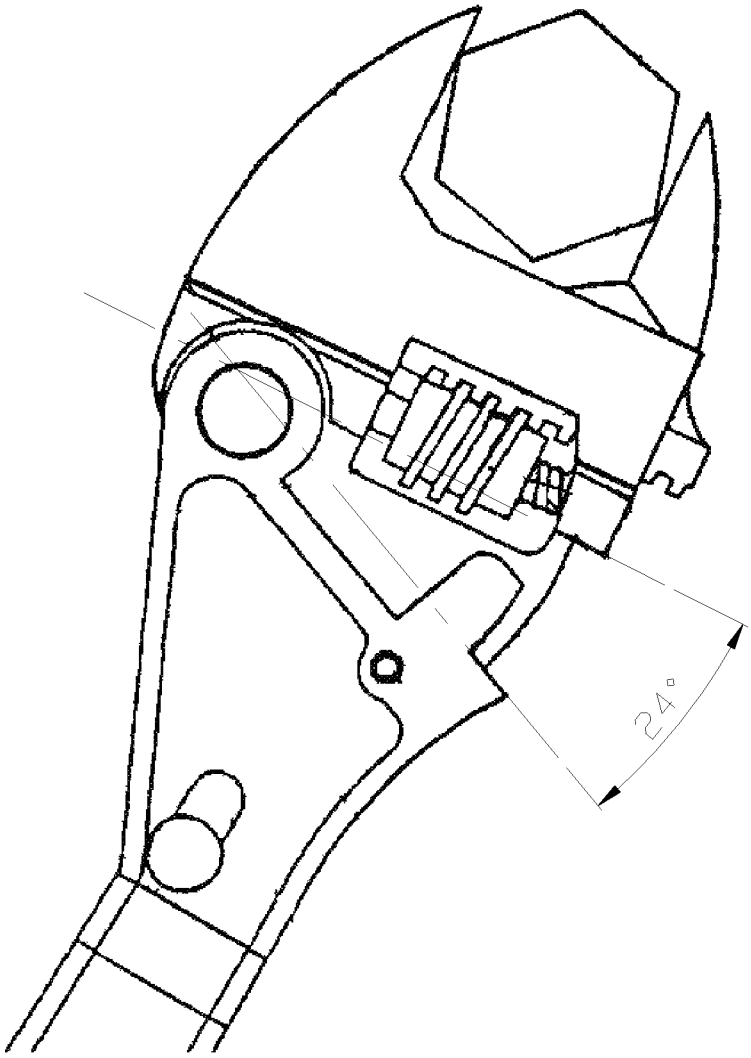
FIG. 9(Prior Art)
FIG. 9 is a perspective drawing showing a different kind of the conventional adjustable wrench.
Figure 10:
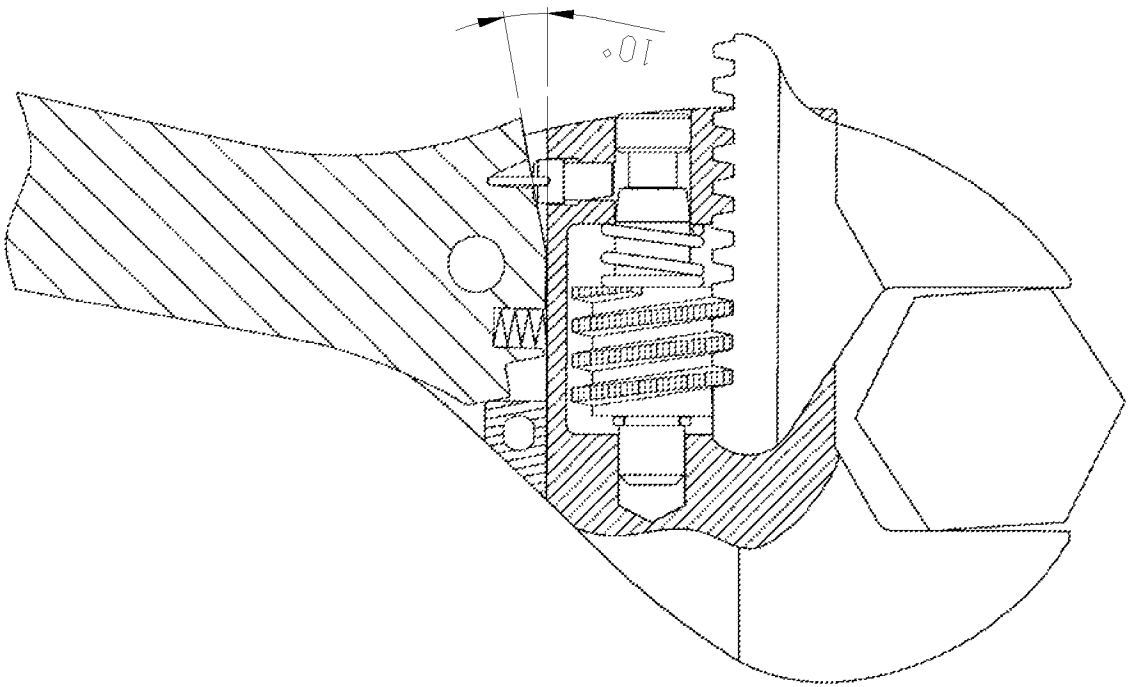
FIG. 10(Prior Art)
FIG. 10 is a perspective drawing showing a different kind of the conventional adjustable wrench.

FIG. 6 and FIG. 7 are perspective drawings showing the adjustable wrench 1 being in a traditional mode. When the adjustable wrench 1 is in a traditional mode, the switch post 64 is in a locked position, which shows that there is no gap between the second end of the switch post 64 and the first notch 246. In other words, the second end of the switch post 64 is completely limited in the first notch 246, which is not allowed to move. At this time, the hexagonal nut 8 will be turned counterclockwise with counterclockwise movement of the handle 4, which is different from the previous mentioned ratchet mode. This shows that the adjustable wrench 1 in the traditional mode can be only operated by traditional operation to disengage or fasten the hexagonal nut, which is similar to the traditional wrench as shown in FIG. 8.

Compared with the prior art, the adjustable wrench 1 of the present invention provides two different modes including the ratchet mode and the traditional mode. It is worth to mention that when counterclockwise operating the adjustable wrench 1, a maximum clamping opening angle for turning the handle away from the fixed jaw 2 is quite small, about 3 degree angle, which cannot be achieved by the conventional wrench.

In addition, the first end of the switch post 64 is a knob 641 exposed outside of the handle 4, which has a size approximately equal to that of the user's thumb. As such, the adjustable wrench 1 of the present invention can achieve the benefits of ergonomic designs and convenient operations.

It will be appreciated that although a particular embodiment of the invention has been shown and described, modifications may be made. It is intended in the claims to cover such modifications which come within the spirit and scope of the invention.

The invention claimed is:

1. A adjustable wrench with ratchet function comprising:

fixed jaw, having a body and a sector block extending from a bottom of the body, the body including a sliding slot, a receiving groove in communication with the sliding slot, a through slit parallel with the sliding slot, and a communicating hole perpendicular to the through slit, the through slit communicating with the receiving groove, the communicating hole vertically communicating with the through slit, an arc edge of the sector block having a first notch and a second notch;

a movable jaw, having a sliding rod, the sliding rod being slidably disposed in the sliding slot of the fixed jaw;

a threaded shaft, having a shaft hole, the threaded shaft disposed in the receiving groove of the fixed jaw and engaged with a toothed portion of the sliding rod of the movable jaw;

an axial rod, inserted through the through slit, the receiving groove and the shaft hole of the threaded shaft, the axial rod being axially movable in the through slit along an axial direction of the through slit, wherein the axial rod having a stop portion against a bottom rim of the threaded shaft;

a spring, disposed in the through slit for allowing the axial rod being elastically movable along the axial direction;

a handle, having a top end, the top end defining a pivot trench for receiving the sector block, the top end of the handle pivoted on an apex of the sector block, wherein the handle further has a recess and a through hole communicating with the pivot trench, the recess facing the communicating hole of the fixed jaw, the though hole being adjacent to the recess and facing the first notch of the sector block;

a stop pin, having a top portion and a bottom portion, the top portion of the stop pin inserting though the communicating hole of the fixed jaw and entering in the through slit to be against the axial rod, the bottom portion of the stop pin entering the recess of the handle and pivoted on the handle with a gap between the recess and the bottom portion of the stop pin; and a switch post, inserting through the through hole of the handle and being movable within the through hole, wherein the switch post has a first end protruding toward outside of the through hole and a second end entering the first notch of the sector block, the switch post having a unlock position where the first notch allows the second end of the switch post to move therein and a lock position where the first notch keeps the second end of the switch post from moving.

2. The adjustable wrench with ratchet function of claim 1, further comprising a return spring and an axle, the return spring disposed in the second notch of the sector block, the axle fixed in the handle, a part of the axle located in the second notch and being against the return spring.

3. The adjustable wrench with ratchet function of claim 1, wherein the handle has two opposite wide surfaces and two opposite narrow surfaces, the through hole defined in one of the narrow surfaces.

4. The adjustable wrench with ratchet function of claim 2, wherein the handle has two opposite wide surfaces and two opposite narrow surfaces, the through hole defined in one of the narrow surfaces.

5. The adjustable wrench with ratchet function of claim 3, wherein the switch post has a ball and a spring, the spring pushing the ball to enable the ball being against an inner wall of the through hole.

6. The adjustable wrench with ratchet function of claim 4, wherein the switch post has a ball and a spring, the spring pushing the ball to enable the ball being against an inner wall of the through hole.

7. The adjustable wrench with ratchet function of claim 1, wherein the switch post has a ball and a spring, the spring pushing the ball to enable the ball being against an inner wall of the through hole.

* * * * *